United States Patent [19]

Gussow

[11] 4,319,439

[45] Mar. 16, 1982

[54] METHOD OF FINISHING THE EXTERIOR WALL OF A PREFABRICATED BUILDING AND TRIM THEREFOR

[75] Inventor: Christopher H. Gussow, Durham, N.C.

[73] Assignee: Hunter Douglas, Inc., Totowa, N.J.

[21] Appl. No.: 146,676

[22] Filed: May 5, 1980

[51] Int. Cl.[3] ..... E04F 19/02; E04F 13/06; E04B 1/00

[52] U.S. Cl. ..... 52/288; 52/468; 52/716

[58] Field of Search ..... 52/288, 716, 459, 461, 52/462, 464, 465, 468, 466, 467

[56] References Cited

U.S. PATENT DOCUMENTS

| | | | |
|---|---|---|---|
| 2,803,858 | 8/1957 | Rader | 52/468 X |
| 3,525,188 | 8/1970 | Torbett | 52/288 |
| 3,742,668 | 7/1973 | Oliver | 52/288 |
| 4,104,839 | 8/1978 | Balzer et al. | 52/288 |
| 4,161,853 | 7/1979 | Weiss et al. | 52/288 |
| 4,189,885 | 2/1980 | Fritz | 52/288 |
| 4,196,553 | 4/1980 | Veach | 52/288 X |
| 4,228,629 | 10/1980 | Chalmers | 52/468 X |

*Primary Examiner*—J. Karl Bell

*Attorney, Agent, or Firm*—Pennie & Edmonds

[57] ABSTRACT

Disclosed is a corner post (90, 100) and zipper trim (40, 50) for aluminum siding (28) which may be applied after the siding (28), thus permitting preassembly of the siding (28) to factory built wall components (14, 16, 18) while avoiding on site customizing of the zipper and corner post. The zipper trim and the corner post trim are each made of two members, a supporting member (40, 90 respectively) and a finish zipper or corner trim member (50, 100 respectively). The support members (40, 90) are secured to the wall components (14, 16, 18) after the wall components (14, 16, 18) have been assembled at the site. The zipper trim (50) and corner post trim (100) members are then snapped into place in engagement with their respective underlying support members (40, 90).

16 Claims, 7 Drawing Figures

METHOD OF FINISHING THE EXTERIOR WALL OF A PREFABRICATED BUILDING AND TRIM THEREFOR

BACKGROUND OF THE INVENTION

1. Field of the Invention

This invention relates to building construction and, more particularly, to the construction of buildings from prefabricated wall components in which such components are manufactured in a factory and then assembled on the site. Still more specifically, this invention relates to trim for the siding for such buildings.

2. Prior Art

Aluminum siding is generally designed for application to existing buildings. Accordingly, various problems are encountered when it is desired to prefabricate a wall component with aluminum siding thereon in a factory for later assembly at the job site into a completed building. For example, in applying aluminum siding to an existing building, the conventional procedure is to provide a starter strip at the bottom of the wall extending horizontally and then to mount the first corner post. Generally, the horizontal siding panels are then applied with their ends being slid into vertical grooves in the previously mounted corner posts. The corner posts serve, among other things, to help insure level and plumb mounting of the horizontal siding panels as well as preventing rain from penetrating behind the aluminum siding. One disadvantage of this system has been the fact that it is very easy to nick or dent the corner post during subsequent application of the several siding panels. In order to overcome this problem, two-piece corner posts have been provided in which a base member is secured to the building, the siding is then applied, and a finishing cap is snapped into place in engagement with the base member after application of the horizontal siding panels. However, in both instances either the corner post or the base must be mounted before the horizontal siding panels are mounted. Accordingly, the conventional trim system for aluminum sided buildings is not adaptable to use where prefabricated wall components are assembled in the factory with aluminum siding thereon. The difficulty resides in the fact that these wall components are constructed to meet at a corner and also on long walls to meet intermediate of corners with the joint between adjacent panels being so designed and constructed as to allow for variation in the foundation size. It is practically impossible to pour a concrete foundation or erect a concrete block foundation that is absolutely perfect in size. The finished foundation may vary from a fraction of an inch to as much as two or three inches plus or minus, usually plus, the intended size. That is, to say, that the foundation tends to be somewhat larger than specified. To accommodate this variation, the factory wall components are constructed such that their vertical edges, whether meeting at a corner or intermediate the corners, form a joint that may be opened up to fit the foundation. This necessitates that the siding applied in the factory also be dimensioned to accommodate variation. To this end, factory constructed preassembled wall components are finished by mounting a J-shaped channel member vertically adjacent to but spaced from the extreme edge of the wall component and nailing the same to the underlying sheathing. Such a vertically mounted J-shaped channel member is provided at both ends of the horizontal aluminum siding panels with the edges inserted within the arms of the J. When, subsequently, these walls are erected, there may or may not be filler blocks provided between adjacent vertical edges of the adjacent panels, depending upon how well the panels fit the foundation. The filler blocks are cut to the requisite size on the site and the panels secured in place. This leaves a vertical gap in the siding at the corners and on the longer walls of the building at a location intermediate the corners. For example, the conventional length for such prefabricated wall components is about twenty feet. If one of the exterior walls, as is frequently the case, exceeds this dimension, then a second wall component must be erected in the same plane which will result in a vertical gap between the J-channels of the siding. Whether at the corner or intermediate the corners, it is not possible to predict the width of this gap. Accordingly, building constructors who adopt the factory built prefabricated wall components are required to rip cut wooden strips on the site which fit the corners properly or the distance between the J-channels. These must then be painted and, at a subsequent time, the builder must return to apply a second coat in order to maintain adequate esthetic appearance. There are a number of drawbacks to this system not the least of which is the fact that the corner post is of a different material as is the "zipper" at any joint intermediate the corners of the building. Moreover, the corner posts and zippers must be cut on site, painted and repainted, adding to the cost of the building. Existing aluminum corner posts, even those with a base and snap-on cap are not suitable for use with such preassembled wall components in which the siding is applied in the factory. Further, there is no available zipper provided by aluminum siding manufacturers.

BRIEF SUMMARY OF THE INVENTION

The present invention is directed to the provision of trim strips and, in particular, a corner post and a zipper which may be applied in the field at the job site to wall components constructed in a factory and already having J-channels and aluminum siding panels applied thereto in the factory.

The corner piece and zipper of this invention each include a first support member which is secured on the job site to the underlying adjacent wall components by any conventional means, such as nailing, gluing, and the like. As mentioned, these components will already have the aluminum siding applied thereto in the factory with J-channels at the ends of the horizontal panels. In the case of the zipper, its support member extends over the joint between the adjacent vertical edges of two adjacent wall components. It is dimensioned to span this joint even when there is a considerable space between the wall components and also to fit between the J-channel on one wall component and the J-channel on the other component, even when the two wall components are tightly fitted together. In the case of the corner post, the support member is positioned at the adjacent vertical edges of adjacent wall components as with the zipper. However, with the corner post, the support member extends around the corner of the building. Again, the support member is so dimensioned as to fit between the adjacent J-channels, even when the joint is tight, while at the same time permitting the joint between the vertical edges of adjacent panels to be opened significantly. Both support members can readily be applied, even though the wall components already have the aluminum siding applied thereto in the factory. After application of the support member to the wall components, the corner cap and the zipper may be simply snapped into place engaging their respective support members. Both the corner cap and the zipper and their respective support members are dimensioned to allow for variation of as much as two inches or more at each joint between the edges of adjacent wall components.

DETAILED DESCRIPTION OF THE INVENTION

Figure 1:
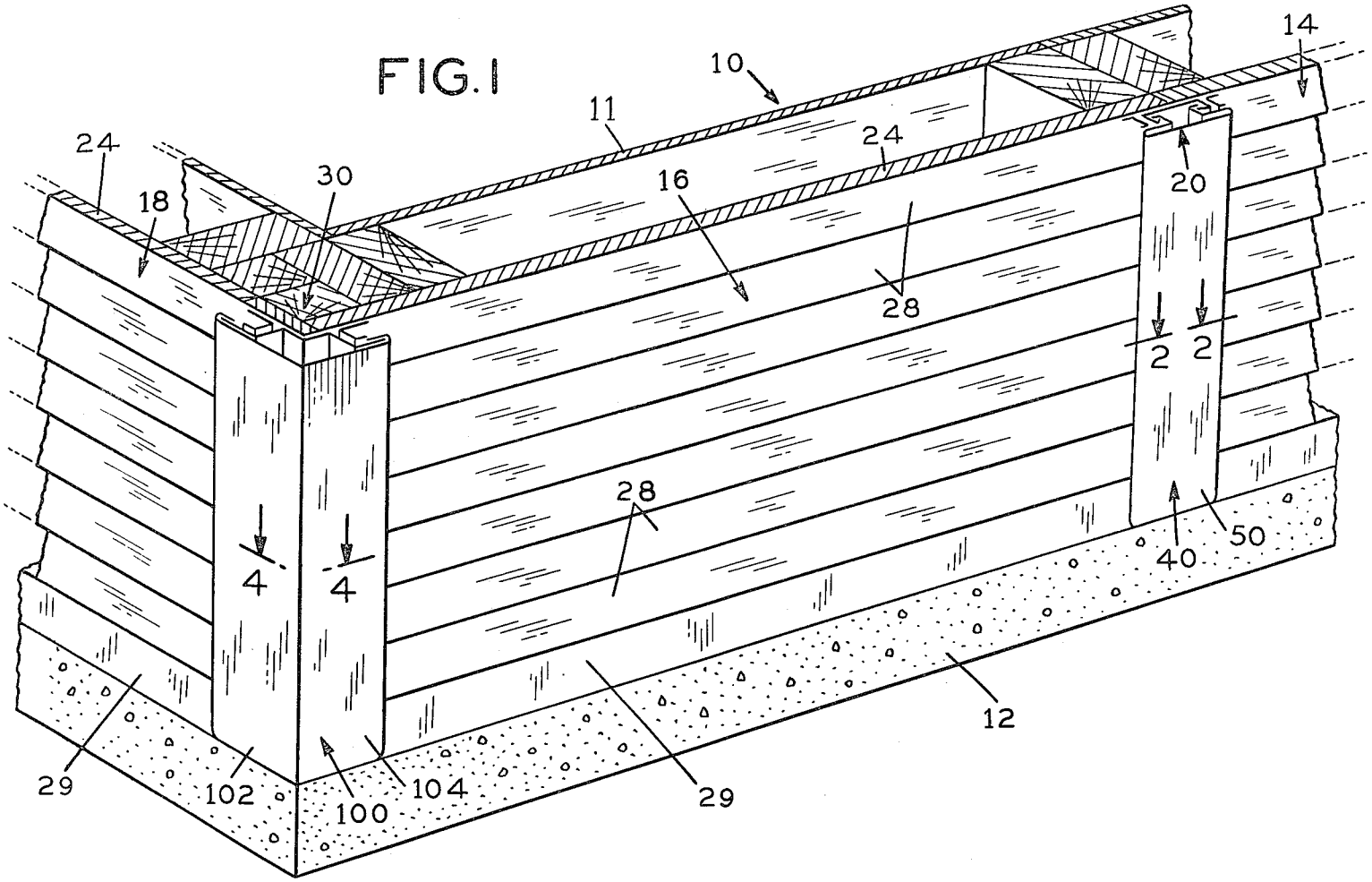
FIG. 1 is a perspective, horizontal cross-sectional view of one corner and portions of two sides of a building being assembled from factory built wall components. No roof structure is shown.

As shown in FIG. 1, a building 10 is being constructed on a foundation 12 previously provided. Only a portion of the building is shown, including all or portions of three wall components 14, 16 and 18. No roof is shown in FIG. 1. The adjacent edges of the components 14 and 16 fit together at a joint 20 intermediate the corners of the building 10 with the components 14 and 16 being positioned in generally the same vertical plane. The components 16 and 18 join at a corner 30 as shown. The details of the joint 20 are best shown in FIGS. 2 and 3.

Figure 2:
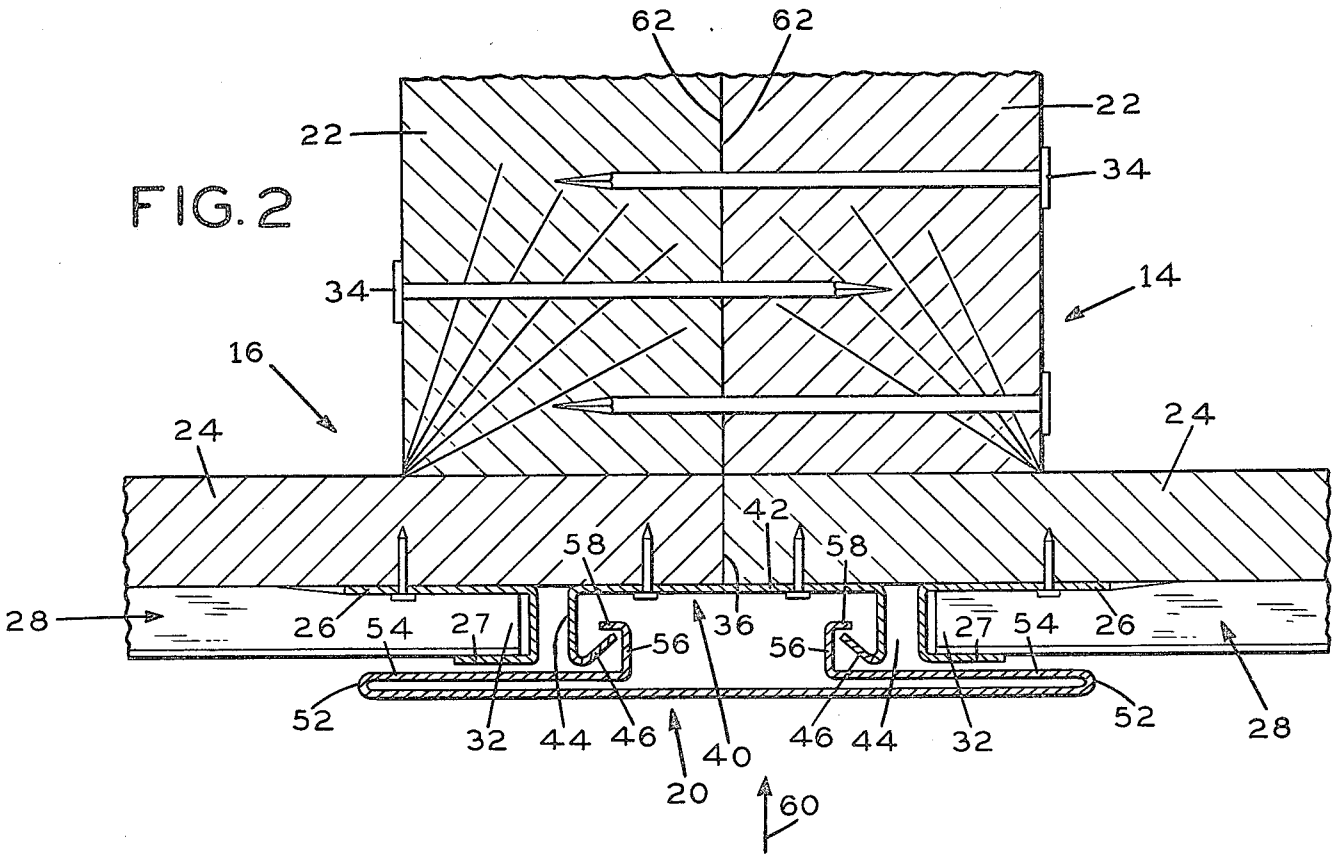
FIG. 2 is a horizontal cross-section taken along the line 2—2 of FIG. 1 at the joint between two adjacent wall components, and showing in cross-section the zipper of this invention.
Figure 3:
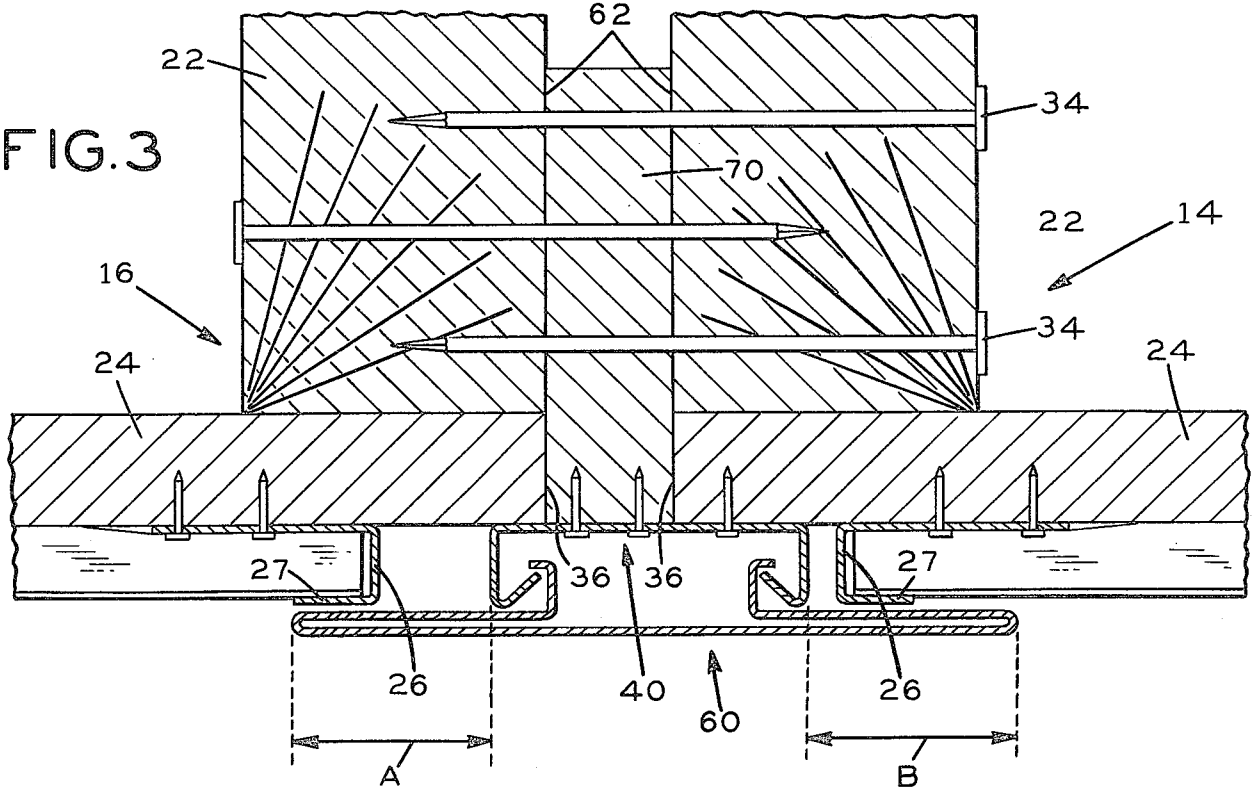
FIG. 3 is like FIG. 2, but showing the adjacent edges of the adjacent wall components spaced apart.

As shown in FIG. 2, the wall components 14 and 16 include a wood frame of which a portion of only one stud 22 for each is shown. Nailed, glued, or otherwise secured to the frame, including the stud 22, is a sheathing material 24 of any conventional type, preferably plywood. Secured by nailing or otherwise to the sheathing 24 are J-shaped channel members 26 which extend vertically of the wall components 14, 16, 18. Also secured to the sheathing in conventional manner are a plurality of horizontally extending aluminum siding panels 28. As is conventional, the vertical cross-section through a panel 28 shows it to be generally wedge-shaped with its wider portion lowermost and with its thin upper longitudinal edge underlying the lower longitudinal edge of the next panel 28 thereabove. The ends 32 of the siding panels 28 extend into the channel of the J-shaped channel member 26 as shown. The J-shaped channel members 26 serve to prevent rain and snow from intruding beyond the siding and into the joint or otherwise into the wall. Any rain driven laterally will be caught by the J-shaped channel members and guided downwardly to the ground.

The elements of the wall components 14 and 16 just described, i.e. frame members 22, sheathing 24, J-shaped channel members 26 and siding material 28 are all applied and assembled in the factory, both in present commercial practice and when using the present invention.

On the site, a crane lifts the wall components 14 and 16 into position as workmen secure the lower plate of the frame 22 to the floor 29 by nailing (not shown). At the joint 20, the stud 22 of the wall component 14 is secured to the stud 22 for the wall component 16 by any conventional means, such as nailing, bolting or the like, with nailing 34 being shown. As shown in FIG. 2, the studs 22 of the frames for the respective wall components 14 and 16 abut each other as do the sheathing elements 24. The siding 28 and the J-channels 26 are, however, set back from the abutting edges 36 of the sheathing material. This leaves a space between the adjacent J-channels 26. In this space is secured a support member generally indicated at 40 and having generally a C-shape in cross-section. The base 42 of the "C" is planar and is nailed to the sheathing 24 as shown and extends across the abutting edges 36 of the sheating members 24. At its opposite vertical longitudinal edges, the base 42 has outwardly extending walls 44, each of which terminates in an inwardly bent flange 46. This support member 40 is preferably sheet metal shaped to the cross-section shown in FIG. 2 and extending the full length of the joint 20 from top to bottom. However, it is possible to use a plurality of shorter members shaped with a cross-section of the support member 40 and to space them along the joint 20 at selected distances over the vertical extent thereof. This latter arrangement is not preferred because of the difficulties attendant upon insuring vertical alignment of each of the separate elements. While sheet metal and, more particularly, aluminum of a thickness 0.024" is preferred for support member 40, it will be appreciated that extruded plastic could be used as well.

Overlying the entire joint 20, including the space between the J-channels 26 and the adjacent ends of the siding material 28, is a finish strip or zipper 50. On each of its vertical lateral edges 52, the zipper 50 is bent back upon itself as at 54 providing a double thickness for strength at the lateral edges. Each of the segments 54 has its inner edge bent from the plane of the face of zipper 50 as at 56. These flanges 56 terminate in turned over lips 58 which engage the edges of the flanges 46 of the support member 40 as shown.

In order to snappingly engage the zipper 50 with the support member 40, it is only necessary to align the two members generally with the lips 58 on the zipper 50 bearing against the outer surfaces of the flanges 46. Then, by applying a pressure in the direction indicated by the arrow 60, the flanges 46 and the flanges 56 are flexed sufficiently to permit the lips 58 to pass by the edges of the flanges 46 and assume the position shown in FIG. 2. The zipper trim member 50 is, preferably, of sheet aluminum 0.019" in thickness although extruded plastic could also be used.

FIG. 3 shows the same construction as in FIG. 2, with the single exception that in FIG. 3 the facing edges 36 of the sheathing elements 24 on the panels 14 and 16 do not abut. Similarly, the facing surfaces 62 on the studs 22 do not abut in FIG. 3 as they do in FIG. 2. Because of the dimensions of the wall components 14 and 16, it has been necessary to space the wall components 14 and 16 some distance apart as shown in FIG. 3. Preferably, this distance is taken up by a wood or other filler member 70 secured in place by nailing, gluing or the like, with the use of nails 34 being shown. This filler member 70 may extend throughout the full vertical extent of the frame studs 22, which arrangement is preferred, or a plurality of fillers 72 of shorter length may be spaced vertically between the facing surfaces 62 of the studs 22.

In FIG. 3, the support member 40 is secured by nailing to the sheathing element 24 of the wall component 14, just as in FIG. 2; however, because of the space between the wall components 14 and 16, it has not been possible to nail the support member 40 to the sheathing element 24 for the left-hand wall component 16. Nailing only to the wall component 14 is generally sufficient; however, it is preferred to also nail the support member 40 to the intermediate filler piece 70 as shown. The support member 40 and the zipper finishing strip 50 are identical in both FIGS. 2 and 3, and the zipper 50 is applied in the same manner by pressing in the direction of the arrow 60 after first making an initial rough alignment, all as described above.

It will be appreciated that the amount of space that can be accommodated in the joint 20 between the wall components 14 and 16 depends upon the combined widths of the members 54 on the zipper 50. That is, the sum of dimension A plus dimension B less the combined length of legs 27 on the adjacent channels 26 determines the maximum spacing that can be tolerated between facing surfaces 62 and still cover the legs 27 of the J-channels. As shown in FIG. 3, all or nearly all of the space has been allocated to the left side of the support member 40 but it will be appreciated that the support member 40 could have just as well been centered between the J-channels 26. Indeed, any spacing between the facing surfaces 62 in excess of dimension A will require some shifting of the support 40 toward the center with the maximum spacing requiring full centering of support 40. In practice, the parts are dimensioned to accommodate a space between the adjacent surfaces 62 of the studs 22 of from 0–2" with approximately 1" being available on each side. As shown in FIG. 3, the parts are positioned so that the left-hand J-channel 26 is just barely covered by the zipper trim 50. If the J-channel 26 is the same color as the siding 28 which will normally be the case, it is possible to accommodate an even greater spacing between the facing surfaces 62 of the studs 22, even though some of the J-channel 26 may be exposed on one or both sides of the zipper 50. Such minimum exposure of the J-channel 26 is not esthetically distracting when the J-channel is the same color as the siding 28.

Figure 4:
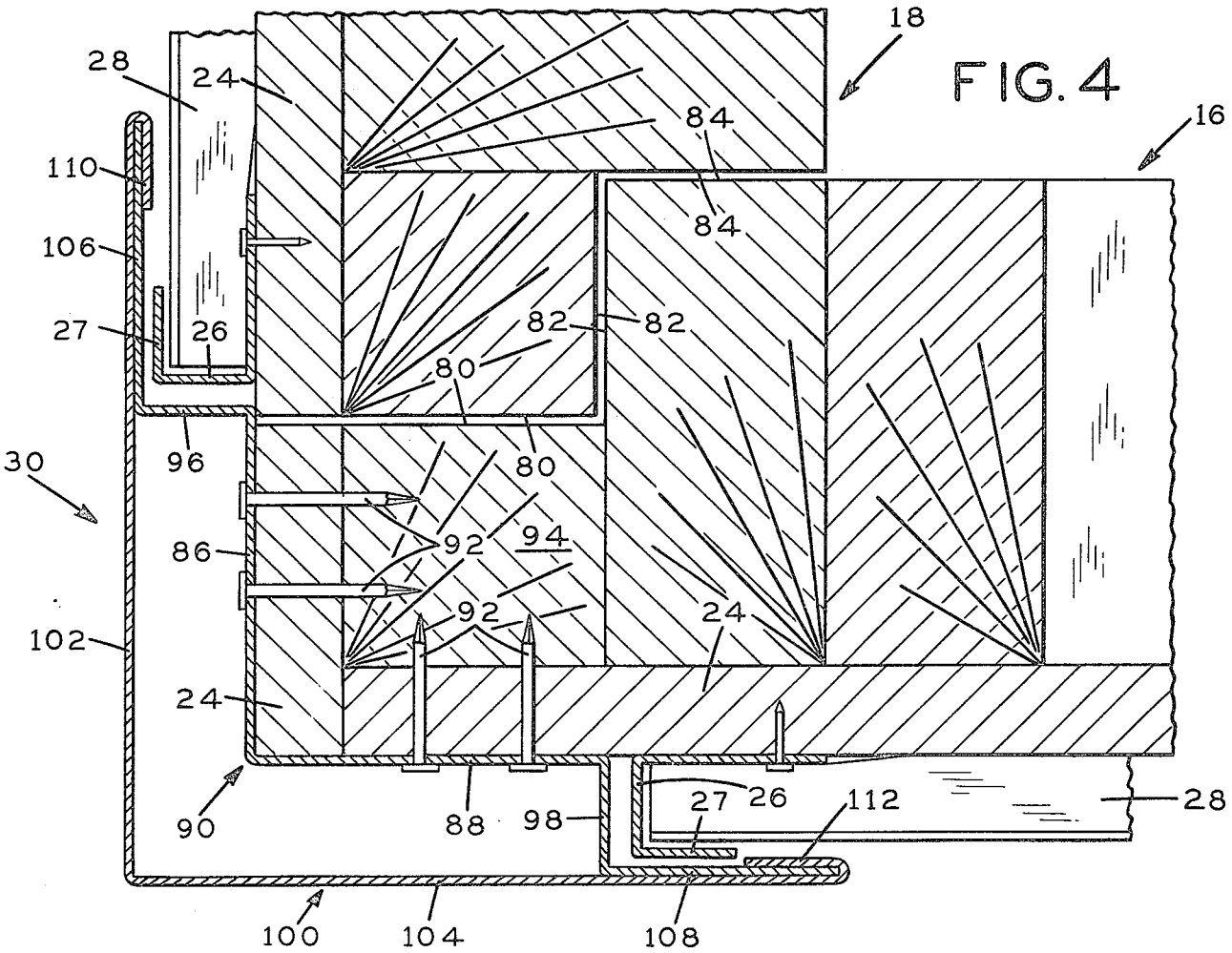
FIG. 4 is a horizontal cross-section taken along the line 4—4 of FIG. 1 through the corner of a building assembled with factory built wall components, and showing the corner post of this invention.

A corner joint 30 is shown in FIG. 4 where the edges 80, 82, 84 of wall component 16 meet with and abut surfaces 80, 82, 84 respectively on the wall component 18. Each of the wall components 16 and 18 is finished on its outer surface by siding material 28, the edges of which are received in J-channels 26 as above described. Between the J-channels 26 and extending around the corner is a corner support member 90 having generally a W-shape in cross-section. The support member 90 includes two segments 86 and 88 at right angles to each other and positioned with the corner between the segments 86 and 88 on the corner of the building. Nails 92 extend through the segments 86, 88 and secure the support member 90 to a stud member 94. At their outer ends, the segments 86, 88 are bent outwardly to form webs 96, 98 respectively. The webs 96, 98 are further bent outwardly and parallel to the face of the wall components 16 and 18 to provide flanges 106, 108 respectively. The corner trim member 100 is bent at a right angle to provide two legs 102, 104, each of which is in turn bent back upon itself at 110, 112 respectively. This provides a space between the legs 102, 104 and their terminal edges 110, 112, which space receives the outwardly extending flanges 106, 108 respectively of the support member 90. In order to engage the corner trim 100 on its support member 90, it is only necessary to engage one of its edges about one of the flanges 106, 108. For example, the corner trim 100 may be manipulated so that the flange 110 and the leg 102 embrace the flange 106 as shown. There is enough flexibility in the support member 90 and, in particular, in the webs 96, 98 to then permit the corner trim 100 to be moved to the right (as viewed in FIG. 4) so that the flange 112 and leg 104 may embrace the flange 108 as shown. During this manipulation, the legs 102, 104 may be spread apart somewhat to further aid in snapping the same into position.

As indicated, the support member 90 and the corner trim 100 are both preferably of sheet aluminum with the support member 90 being 0.024" thick and the corner trim 100 being 0.019" thick.

Figure 5:
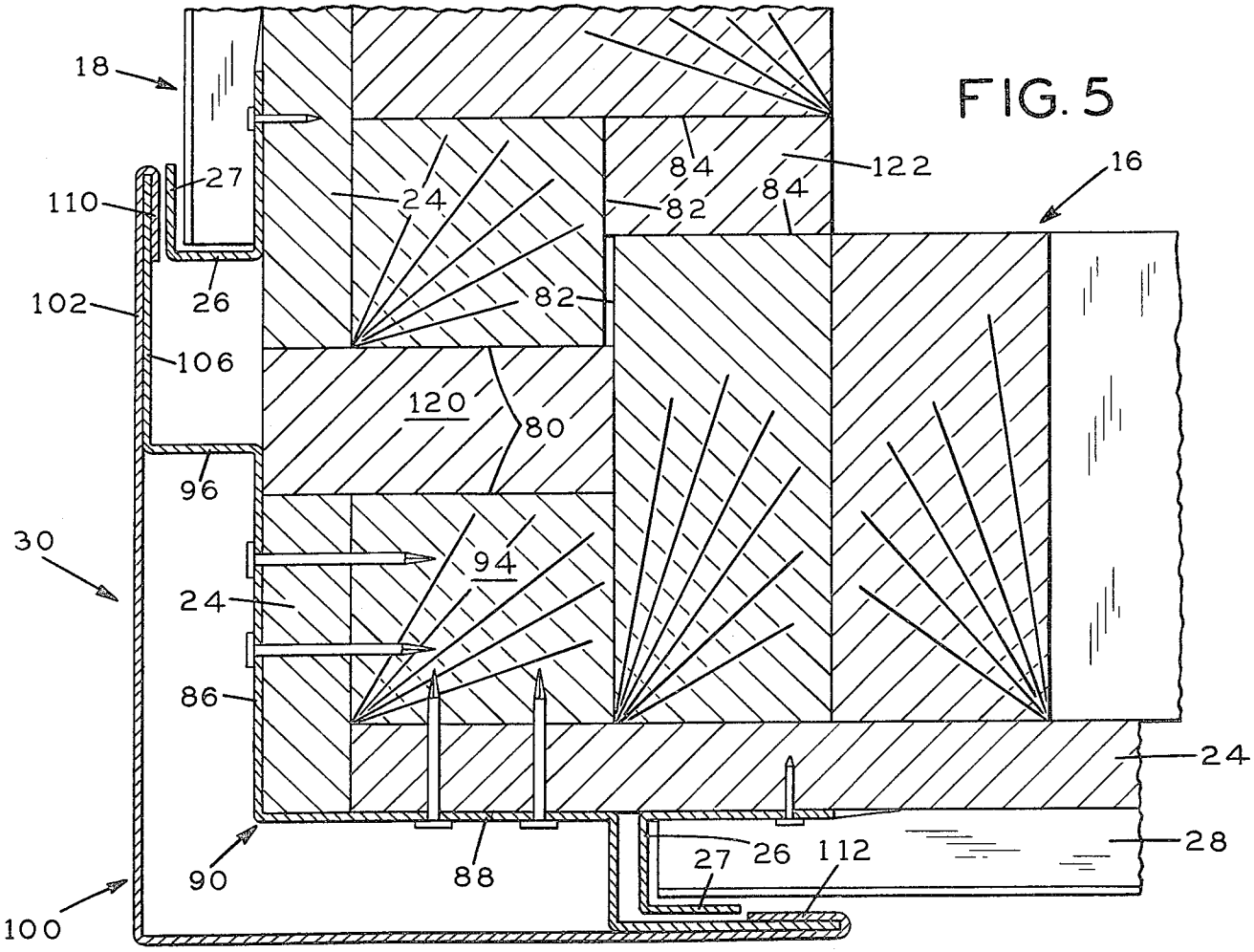
FIG. 5 is a view like FIG. 4, but showing the adjacent edges of the two adjacent wall components spaced apart.

There is shown in FIG. 5 the manner in which the novel corner post trim of this invention adjusts for a gap between the wall components 16 and 18. In FIG. 5, the surfaces 80 and 84 on wall component 16 are spaced from surfaces 80, 84 on the wall component 18. The facing surfaces 82 on the wall components 16 and 18 are shown as abutting over a portion of their width but not over their entire width as in FIG. 4. Wooden filler members 120, 122 are, preferably, provided in the space between the facing surfaces 80, 84 of the wall components 16 and 18, which filler members 120, 122 may be nailed in place of glued. As will be apparent from the figure, the J-shaped channel member 26 on the wall component 18, shown to the left in FIG. 5, is now spaced from the web 96 of the support member 90 due to the fact that the wall components 16 and 18 do not fit tightly together. Nevertheless, the J-shaped channel member 26 is still hidden by the leg 102 and the inturned flange 110 of the corner trim 100. As will be apparent, the amount of space between the edges of the wall components 16 and 18, which may be accommodated by the corner post trim 90, 100, will depend upon how far the leg 102 extends from web 96 along and parallel to the front face of the wall component 18. In actual use, the leg 102 is made long enough to accommodate a space between the facing surfaces 80 of the wall components 16 and 18 of from 0 to about 3". The leg 104 is made of the same length as the leg 102 for several reasons. Esthetically, the corner trim 100 is more attractive if the legs 102 and 104 are of the same length, but also this avoids having a left- and a right-hand side to the corner trim 100 so that the corner trim 100 can be reversed with the leg 102 where the leg 104 is shown in FIG. 5 and vice versa. Moreover, as with the zipper of FIGS. 1 and 2, the J-shaped channel member 26 may be of the same color as the siding 28, in which event, even if it is partially exposed beyond the end of leg 102, it will not be esthetically displeasing. Accordingly, an additional increment of adjustment is possible.

Figure 6:
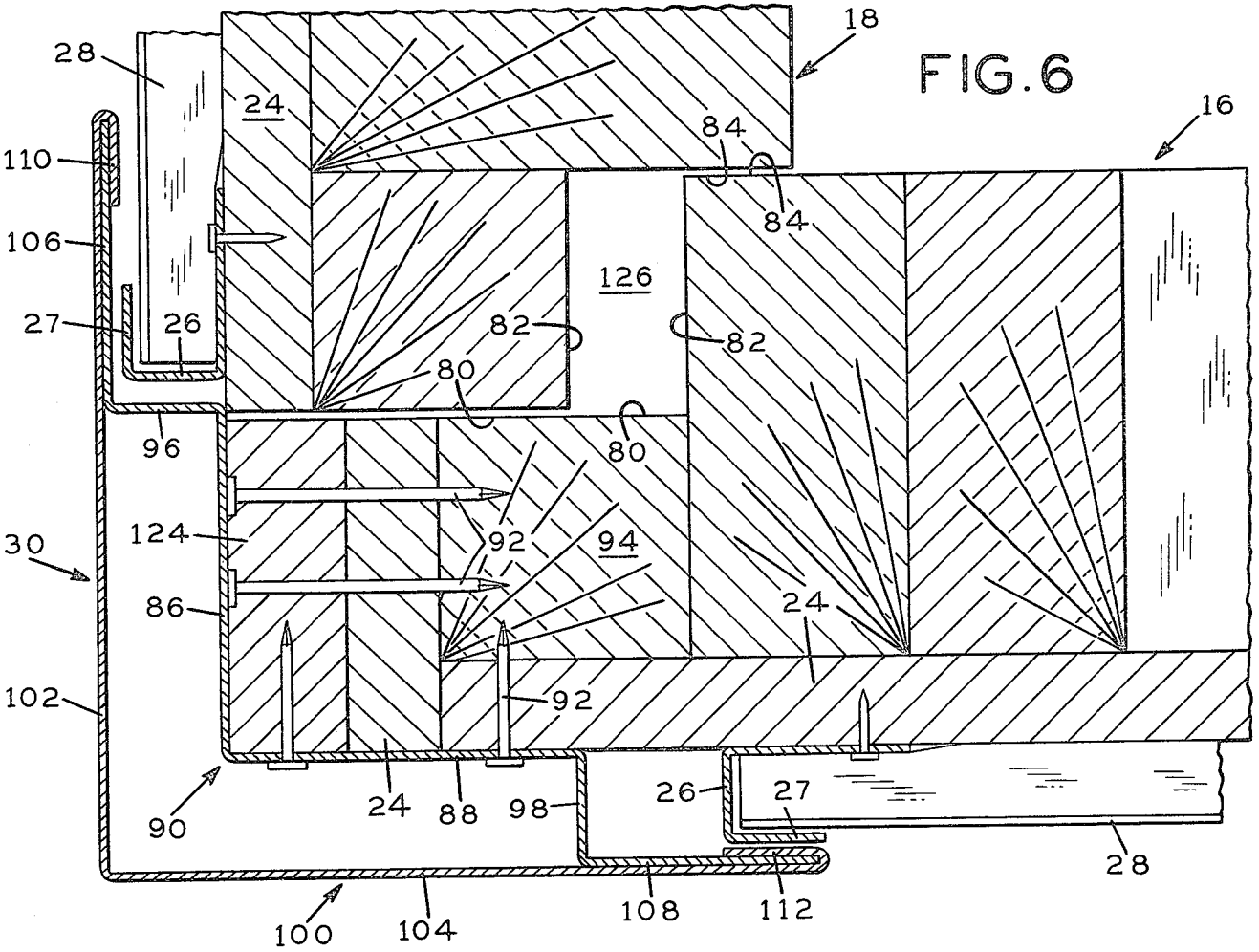
FIGS. 6 and 7 are like FIG. 5, but showing the two adjacent wall components spaced apart in different manners.

FIG. 6 is a showing similar to FIG. 5. In FIG. 5 the wall component 16 fully reached the corner of the foundation while wall component 18 did not fully reach wall component 16, thus requiring filler blocks 120 and 122. In FIG. 6, on the other hand, wall component 16 does not quite reach the corner of the foundation while wall component 18 does fully reach wall component 16, as it did in FIG. 4. The result is that surface 82 on wall component 16 is spaced from surface 82 on wall component 18. Surfaces 80 and 84 on wall component 16 do abut surfaces 80 and 84 on wall component 18 but only along a portion of their length. Further, a filler block 124 is required in order to make wall component 16 fully reach the corner of the foundation. The filler block 124 is added to wall component 16 to fill out the corner and, thus, permit application of the corner support member 90 and corner cap 100 in the manner shown in the drawing. The failure of wall component 16 to meet the corner of the foundation does result in a space 126, in part defined by the facing surfaces 82 on the wall components 16 and 18. This space 126 is not detrimental and need not be filled, although it may be filled if desired.

It will be seen from FIGS. 5 and 6 that the corner trim construction, including the support member 90 and corner cap 100, can be used regardless of whether it is wall component 16 or wall component 18 that is short.

Figure 7:
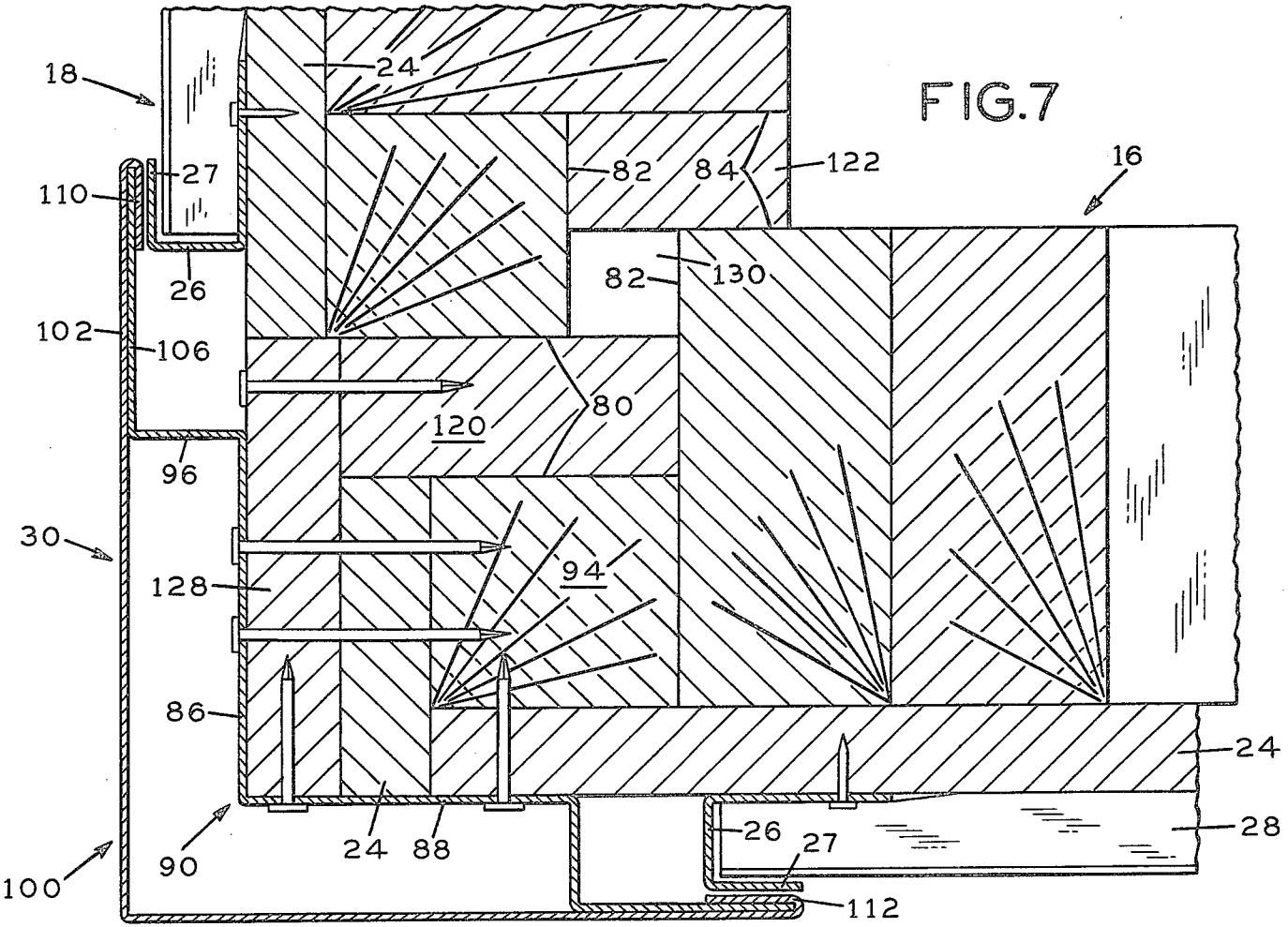

FIG. 7 shows that the corner post of the invention, including the support member 90 and corner cap 100, is equally useful when both wall components 16 and 18 are short. As shown in FIG. 7, the fact that wall component 18 does not quite reach wall component 16 necessitates the insertion of filler blocks 120, 122, just as in FIG. 5. In addition, however, wall component 16 is short of the corner and, as such, it requires a filler block 128 similar to but differently dimensioned than the filler block 124 of FIG. 6. It will be seen, therefore, that the corner post of this invention is equally useful when both wall components 16 and 18 are short. In the condition shown in FIG. 7, a space 130 analogous to space 126 in FIG. 6 remains which may be filled with a filler block, if desired, though such is not necessary.

It should be noted that in FIG. 1 an internal finish 11 is shown. This may be any suitable dry wall construction, such as plasterboard or the like. Normally, this internal surface 11 is not applied until after erection of the walls since the prefabricated wall components 14, 16 and 18 include electric wiring and boxes which must be inspected by the local authorities. As such, the interior surface 11 is not applied in the factory but, rather, is applied on the job site after inspection of the wiring by a local inspector. The interior surface 11 is not shown in the other figures other than FIG. 1 merely for the draftsman's convenience. Similarly, the internal wiring and insulation normally present between the sheathing 24 and the internal finish 11 is not shown.

I claim:

1. In this method of finishing the exterior of factory prefabricated exterior building wall components, which wall components each have an assembled frame, sheathing and siding applied to the exterior of the wall component, and in which said siding includes a plurality of horizontally arranged elongated panels and a J-shaped channel member extending vertically of the wall component at each end of the horizontal panels with the ends of the panels positioned within the channel of the J-shaped channel member, and all of the above having been preassembled in a factory, the improvement comprising:

(a) assembling a plurality of wall components at the building site with the vertical edge of one component adjacent to the vertical edge of an adjacent component, which vertical edges form a joint;

(b) positioning a support member over said joint and between the J-shaped channel of one component and the adjacent J-shaped channel of the adjacent component;

(c) securing said support member to at least one of said wall components; and (d) securing a finishing trim to said support member in a position such that said finishing trim overlies at least a portion of the short leg of each of said adjacent J-channels.

2. The method of claim 1, in which said trim member overlies substantially all of the short leg of both adjacent J-channels.

3. The method of any one of claims 1 or 2, including the step of placing a filler block in said joint prior to securing said support member.

4. The method of claim 3, including also securing said support member to said filler block.

5. A zipper trim unit for use at the joint between two adjacent prefabricated wall components having siding thereon, which adjacent wall components have adjacent vertical edges forming a joint, said trim unit comprising:

(a) an elongated support member having a generally C-shape in cross-section including a base, a web at each of the lateral longitudinal edges of said base extending outwardly from said base at substantially a right angle, the outer edges of said webs extending inwardly to provide flanges, the included angle between each flange and its respective web being an acute angle, the terminal edges of the flanges being spaced from said base, said support member being of a material that renders said flanges inherently resilient; and (b) an elongated finishing trim having a face of a width greater than the width of said support base, a pair of rib members, each of said rib members extending rearwardly from the rearward surface of said face from a point inwardly of one of the lateral edges of said face, each of said rib members terminating in lips extending away from each other, the distance between said ribs being less than the distance between the webs on said support member, the distance between said lips being greater than the distance between the terminal edges of the flanges on said support member, and said trim being of a material that renders said ribs inherently resilient.

6. A corner trim unit for use at the corner of the building formed by two adjacent prefabricated wall components having siding thereon, which adjacent wall components have adjacent vertical edges forming said joint, said corner trim unit comprising:

(a) an elongated support member having a generally W-shape in cross-section including a base, said base being provided by two integral segments disposed at a right angle to each other, each of said segments having a web, each of said webs extending generally outwardly at a right angle from the longitudinal edge of its respective segment that is remote from the other segment, each of said longitudinal edges of said segments from which said webs extend being free of any other outwardly extending element, each of said webs terminating in a flange extending generally at a right angle to its associate web in a direction parallel to and away from the segment from which its respective web extends, said support member being of a material that renders said webs inherently resilient; and (b) an elongated corner cap comprising two elongated trim segments arranged at a right angle to each other and joined integrally with each other along their adjacent edges, each of said segments terminating along their outer longitudinal edge in a flange integral therewith, each of said flanges being substantially parallel to and spaced from the rear surface of its respective segment by a distance to receive frictionally therein one of the flanges of said support member.

7. A prefabricated building having a plurality of prefabricated wall components, each of which has at least one vertical edge adjacent to a vertical edge of an adjacent wall component forming at least one joint, said joint being at or adjacent a corner of the building, said wall components having thereon horizontally extending siding panels, a vertical J-shaped channel member on each of said wall components spaced from the vertical edge thereof, the ends of said horizontal panels being positioned within the channel of said J-shaped channel member, a corner trim covering said corner joint comprising:

(a) an elongated support member having a generally W-shape in cross-section including a base, said base being provided by two integral segments disposed at a right angle to each other, each of said segments having a web, each of said webs extending generally outwardly at a right angle from the longitudinal edge of its respective segment that is remote from the other segment, each of said longitudinal edges of said segments from which said webs extend being free of any other outwardly extending element, each of said webs terminating in a flange overlapping a portion of the J-shaped channel member and extending generally at a right angle to its associated web in a direction parallel to and away from the segment from which its respective web extends, said support member being of a material that renders said webs inherently resilient; and (b) an elongated corner cap comprising two elongated trim segments arranged at a right angle to each other and joined integrally with each other along their adjacent edges, each of said segments terminating along their outer longitudinal edge in a flange integral therewith, each of said flanges being substantially parallel to and spaced from the rear surface of its respective segment by a distance to receive frictionally therein one of the flanges of said support member.

8. The building of claim 7 in which a vertical edge of one of said wall components is positioned adjacent the vertical edge of an adjacent wall component at a point intermediate the corners of the building to form an intermediate joint along the length of the wall, said intermediate joint being covered by a zipper comprising:

(a) an elongated support member having a generally C-shape in cross-section including a base, a web at each of the lateral longitudinal edges of said base extending outwardly from said base at substantially a right angle, the outer edges of said webs extending inwardly to provide flanges, the included angle between each flange and its respective web being an acute angle, the terminal edges of the flanges being spaced from said base, said support member being of a material that renders said flanges inherently resilient; and (b) an elongated finishing trim having a face of a width greater than the width of said support base, a pair of rib members, each of said rib members extending rearwardly from the rearward surface of said face from a point inwardly of one of the lateral edges of said face, each of said rib members terminating in lips extending away from each other, the distance between said ribs being less than the distance between the webs on said support member, the distance between said lips being greater than the distance between the terminal edges of the flanges on said support member, and said trim being of a material that renders said ribs inherently resilient.

9. The building of either claim 7 or 8, in which at least one of said joints includes a filler block.

10. The building of either claim 7 or claim 8, in which both of said joints include a filler block.

11. The building of claim 8, in which said finishing trim is positioned to overlie at least a portion of the short leg of both the adjacent J-channels of said intermediate joint.

12. The building of claim 8, in which said finishing trim is positioned to overlie substantially all of the short leg of both of the adjacent J-channels of said intermediate joint.

13. The building of any one of claims 7, 8, 11 or 12, in which said corner cap is positioned to overlie at least a portion of the short leg of both of the adjacent J-channels of said corner joint.

14. The building of any one of claims 7, 8, 11 or 12, in which said corner cap is positioned to overlie substantially all of the short leg of both of the adjacent J-channels of said corner joint.

15. The building of claim 13, in which said corner joint includes a filler block.

16. The building of claim 14, in which said corner joint includes a filler block.

* * * * *